US005881463A

United States Patent [19]

Casteel et al.

[11] Patent Number: 5,881,463

[45] Date of Patent: Mar. 16, 1999

[54] CARPET FACE CUTTER WITH COACTING SURFACES AND CUTOUTS FOR SECURING THE LOWERMOST CORNER OF EACH CUTTER BLADE AGAINST DEFLECTION

[75] Inventors: James Vernon Casteel, Livermore; Michael David Wenzel, Pleasanton, both of Calif.

[73] Assignee: Orcon Corporation, Union City, Calif.

[21] Appl. No.: 748,103

[22] Filed: Nov. 12, 1996

[51] Int. Cl.[6] ..... B26B 29/00

[52] U.S. Cl. ..... 30/280; 30/287; 30/293; 30/294; 30/304; 30/314; 30/320; 30/335

[58] Field of Search ..... 30/162, 163, 278, 30/279.2, 280, 282, 283, 286, 287, 289, 290, 293, 294, 335, 299, 304, 314, 317, 320, 65, 71, DIG. 3

[56] References Cited

U.S. PATENT DOCUMENTS

| | | | |
|---|---|---|---|
| 625,550 | 5/1899 | Geisendorff et al. | 30/294 |
| 2,238,678 | 4/1941 | Cook | 30/294 |
| 2,291,294 | 7/1942 | Holste | 30/294 |
| 2,601,414 | 6/1952 | Mittelstaedt | 30/294 |
| 2,772,476 | 12/1956 | Glotzer | 30/304 |
| 3,009,247 | 11/1961 | Mueller | 30/294 |
| 3,337,955 | 8/1967 | Poletajev | 30/294 |
| 3,395,453 | 8/1968 | Prater | 30/293 |
| 3,448,519 | 6/1969 | Tobias | 30/293 |
| 3,543,400 | 12/1970 | Scott et al. | 30/280 |
| 3,605,267 | 9/1971 | Brenner | 30/287 X |
| 3,621,573 | 11/1971 | Summers | 30/287 |
| 3,737,932 | 6/1973 | Armijo | 7/14.1 |
| 3,859,725 | 1/1975 | Anderson et al. | 30/294 |
| 3,934,341 | 1/1976 | Carlson | 30/287 |
| 4,064,627 | 12/1977 | Zanfini | 30/287 |
| 4,095,341 | 6/1978 | Crain | 30/287 |
| 4,833,956 | 5/1989 | Roberts | 83/56 |
| 5,010,650 | 4/1991 | Despins et al. | 30/299 X |
| 5,209,148 | 5/1993 | MacDonald | 83/56 |

FOREIGN PATENT DOCUMENTS

| | | | |
|---|---|---|---|
| 821773 | 9/1969 | Canada | 30/71 |
| 907305 | 8/1972 | Canada | 30/65 |
| 2656964 | 6/1978 | Germany | 30/286 |

OTHER PUBLICATIONS

*Crain Floor Covering Tools: Catalog No. 119C,* Crain Cutter Co., Inc., Milpitas, California (Published before Feb. 28, 1992). Index and 6 selected pages of Cutting Implements.

*Primary Examiner*—Rinaldi I. Rada
*Assistant Examiner*—Boyer Ashley
*Attorney, Agent, or Firm*—Medlen & Carroll, LLP

[57] ABSTRACT

A cutter for face cutting of carpeting is provided. The cutter includes a floor engaging base and a plate attached to the floor engaging base which is slidable along an inclined path forming an acute angle with the base to form between the movable plate and the base a forwardly facing carpet receiving slot having a longitudinal central axis. A downwardly and rearwardly inclined cutting blade disposed in a plane which is parallel to and spaced to one side of a longitudinal central axis of the carpet receiving slot spans the rear end of the carpet receiving slot at the same acute angle as that formed by the inclined path of the floor engaging base, and is secured in a blade housing having an open-ended slot to provide easy access for adjustment, removal, and replacement of blades. Also provided are coacting bearing surfaces for securing the lowermost end of the blade against deflection, and cutouts for preventing an accumulation of debris around the lowermost corner of the blade.

12 Claims, 5 Drawing Sheets

CARPET FACE CUTTER WITH COACTING SURFACES AND CUTOUTS FOR SECURING THE LOWERMOST CORNER OF EACH CUTTER BLADE AGAINST DEFLECTION

TECHNICAL FIELD OF THE INVENTION

This invention relates generally to cutting implements, and more particularly to instruments for face cutting carpets.

BACKGROUND OF THE INVENTION

It is often necessary, when carpeting a large area, such as a wide floor, with wall-to-wall carpeting, to seam together two or more widths of carpeting in order to cover the entire area. This is because carpeting is manufactured and sold in standard widths that are often smaller than the areas which are to be carpeted. In a conventional face-seaming process, the seam between two carpet pieces is created by cutting the adjoining carpet pieces to create clean edges for seaming, abutting the clean edges, and joining the closely abutting edges of carpeting together using a hot-melt carpet seaming tape.

Because it is desirable to make the seams between the pieces of carpeting as invisible as possible, it is important that the edges of the carpeting to be joined be cleanly cut without cutting or snagging yarns in the carpet pile. Face cutting, in particular, can be difficult since the space between rows of carpet pile is often small. Simply laying a straight edge along the top of the carpeting and cutting downward with a blade through the carpeting pile and backing, for example, typically produces unsatisfactory results. When carpeting is face cut—that is, from the pile side—tufts of pile fibers will inevitably be snagged and cut as they are trapped between the backing and the blade. These missing fibers will make the seam visible. The effect is the same as if one took a small pair of scissors and cut some of the pile along a line: producing a cut area which will be clearly visible.

One method for avoiding this difficulty is by using a guide rail for cutting in a relatively straight line from the top of carpeting through the backing between the pile fibers. For example, in U.S. Pat. No. 3,621,573 to Summers a guide rail rests on the top surface of the carpet backing between the pile fibers, and a blade aligned with the guide rail extends downward to cut through the carpeting as the guide rail moves over it. In Canadian patent 907,305, a rug cutting tool which has two parallel guides on either side of the tool body includes a blade disposed between the two plates for cutting down through the carpet between two rows of pile fibers. However, such cuts, which pass through the center of the gap between two rows of pile, when joined in a seam, there is frequently a gap between the adjacent rows of pile of the two carpet pieces, indicating the presence of a seam.

U.S. Pat. No. 3,543,400 to Scott et al. discloses a cutter for face cutting of loop pile carpet having a floor engaging base, a forwardly facing carpet receiving slot above the base, which is spanned at the rear of the slot by an inclined left-hand or right-hand cutting blade for cutting close to the carpet pile on the left-hand or right-hand side. The effect is to reduce the size of the gap between the piles of the abutting edges of two pieces of carpet to be joined in a seam, thus reducing the visibility of the seamed area. However, the Scott et al. patent has a number of deficiencies. Scott et al. provide a recess or notch in the floor engaging base for the lowermost corner of the lowered blade. As cutting progresses, the notch or slot fills with small cuttings and latex fillers. The cuttings tend to pack to the outside, causing the corner of the blade to deflect to the inside, increasing the inaccuracy of the cut and making it difficult, when the cut is complete, to replace or reset the blade to the extended position. In some instances, the lowermost corner of the blade can be forced up, out of engagement with the slot, requiring termination of the cutting procedure before it is completed. Cutting cannot be resumed until the blade is removed and the slot cleaned using a pick-like instrument.

Furthermore, Scott et al. provides a pair of shoulders that the bottom surface of the blade rests against. These shoulders can cause binding of the blade, making it difficult to advance or retract the blade when desired, and can permit some undesirable movement of the blade during cutting which, again, increases the inaccuracy of the cut. Finally, Scott et al. does not provide any positive means for accessing the blades to enable them to be moved into the advanced or retracted position.

Accordingly, the need exists for an improved carpet cutter which can be used for face cutting carpeting, and which avoids the accumulation of cuttings, prevents deflection of the blade for increased accuracy of cuts, and provides easy access to the blades.

SUMMARY OF THE INVENTION

The present invention provides an improved face cutter for face cutting carpeting. A preferred cutter of the present invention includes a floor engaging base and a movable plate attached to the floor engaging base which is slidable along an inclined path forming an acute angle with the base to form between the movable plate and the base a forwardly facing carpet receiving slot having a longitudinal central axis. The carpet receiving slot can be varied in width from a minimum closed position to a maximum open position, and a threaded fastener can be used to secure the movable plate in the desired position between the minimum, closed position and the maximum open position. Also provided is at least one, and preferably two, downwardly and rearwardly inclined cutting blades spanning a rear end of the carpet receiving slot. In the preferred embodiment, a first blade is disposed in a plane which is parallel to and spaced to one side of the longitudinal central axis of the carpet receiving slot, with the cutting edge of the blade being inclined at an acute angle relative to the base which is parallel to the angle along which the movable plate slides to open and close the carpet receiving slot. The second blade is disposed in a plane which is parallel to and spaced to an opposite side of the longitudinal central axis of the carpet receiving slot from the first blade. The second blade is disposed the same distance from the longitudinal central axis and at the same angle as the first blade. A bearing surface is provided for securing the lowermost end of the blade against deflection towards the central longitudinal axis of the carpet receiving slot, and a groove having a flat bearing surface against which the outside surface of the lowermost corner of the blade bears against is provide to secure the lowermost corner of the blade against deflection away from the central longitudinal axis of said carpet receiving slot. Finally, the present invention includes a cutout in the base behind and beneath the lowermost corner of the cutting blade which prevents the accumulation of debris in the groove and around the lowermost corner of the blade by providing a substantially unobstructed passage to enable debris to move away from the corner of the blade during the cutting operation. In addition, an improved blade housing is disclosed having an open ended slot to permit easy access to the blade in each housing, and also including flat bearing surfaces against which the cutting edges of the blade in the housing bears.

The other features, advantages and embodiments of the present invention will become apparent to one skilled in the art from reading the Detailed Description of the Invention together with the drawings.

DETAILED DESCRIPTION OF THE INVENTION

Figure 1:
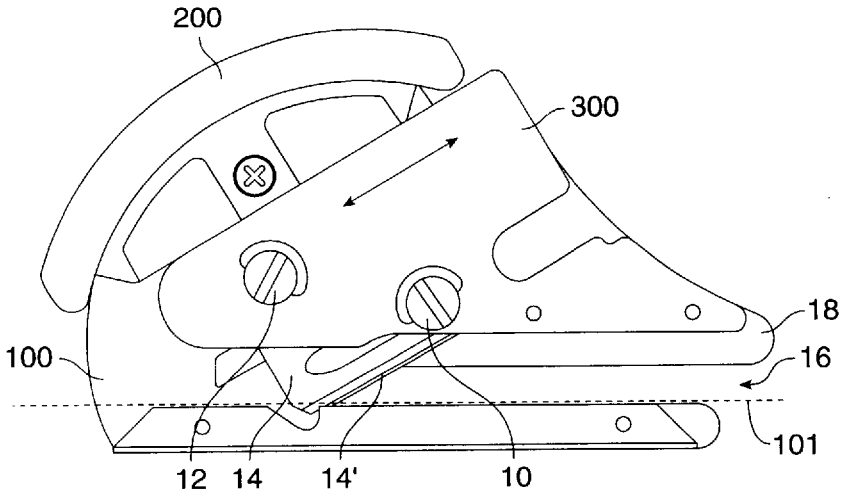
FIG. 1 is a side view of a cutter of the present invention.

As shown in FIG. 1, a cutter of the present invention includes three primary subassemblies: a base plate assembly 100, a handle 200, and a blade support assembly 300.

Figure 2:
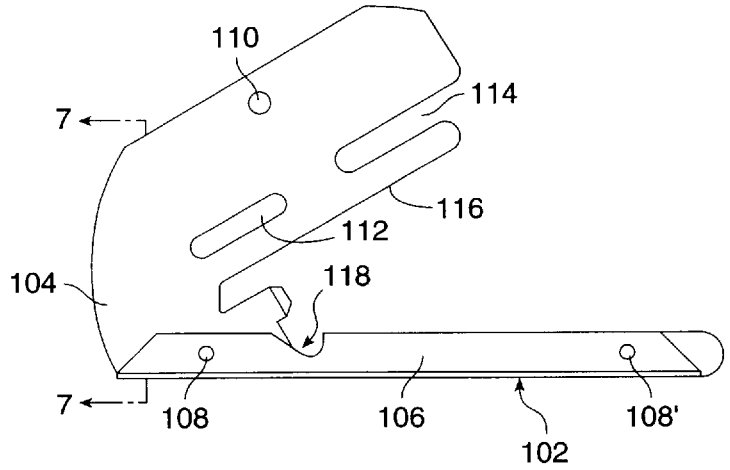
FIG. 2 is a side view of a base plate assembly of a cutter of the present invention.
Figure 3:
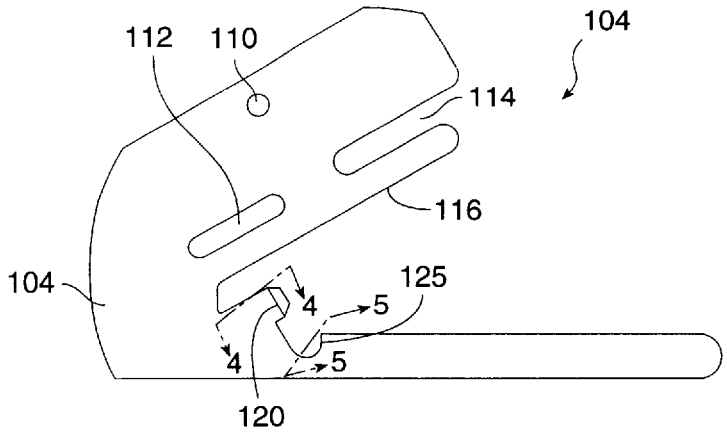
FIG. 3 is a side view of the mounting bracket of the base plate assembly shown in FIG. 2.
Figure 7:
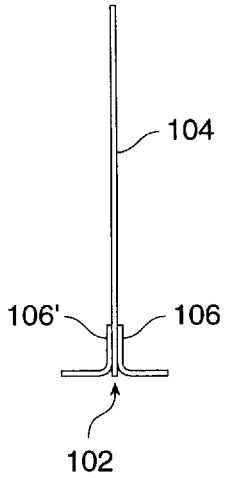
FIG. 7 is a cross-sectional view of the base plate assembly taken through line 7—7 of FIG. 2.

As shown in FIGS. 2 and 7, the base plate assembly 100 includes a floor engaging base 102 and a mounting bracket 104. Floor engaging base 102 is formed from two "L" shaped brackets 106, 106' fastened by an appropriate means, for example by welding 108, 108', to either side of the mounting bracket 104 as shown in FIG. 3. Mounting bracket 104 and brackets 106, 106' can be formed from any substantially rigid and durable material, such as, for example, steel. As shown in FIG. 2, a hole 110 is preferably provided in the top of the mounting bracket 104 for conventionally mounting a handle 200 with a threaded fastener. Handle 200 is preferably conventionally formed from a plastic, although a wide variety of other durable materials, such as wood or metal, could also be used.

A slot 112 is preferably provided in the mounting bracket 104 for mounting the blade support assembly 300 with threaded fastener 12, shown in FIG. 1, for slidable movement and for locking the blade support assembly in a desired position whereby carpet receiving jaw 16 can be opened or closed as desired to accommodate different thicknesses of carpet. An open-ended slot 114, and bearing surface 116 is provided in the mounting bracket 104 for engagement with the blade support assembly 300. Finally, an important feature of the present invention is the rearwardly extending cutout 118, which prevents an accumulation of debris around the lowermost corner of a blade 14, 14' shown in FIG. 1, by providing a substantially unobstructed passage for such debris beneath and behind the blade.

Figure 4:
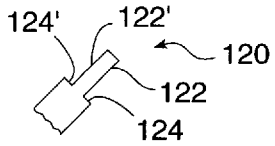
FIG. 4 is a cross-section taken through line 4—4 of FIG. 3.
Figure 5:
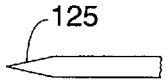
FIG. 5 is a cross-section taken through line 5—5 of FIG. 3.
Figure 6:
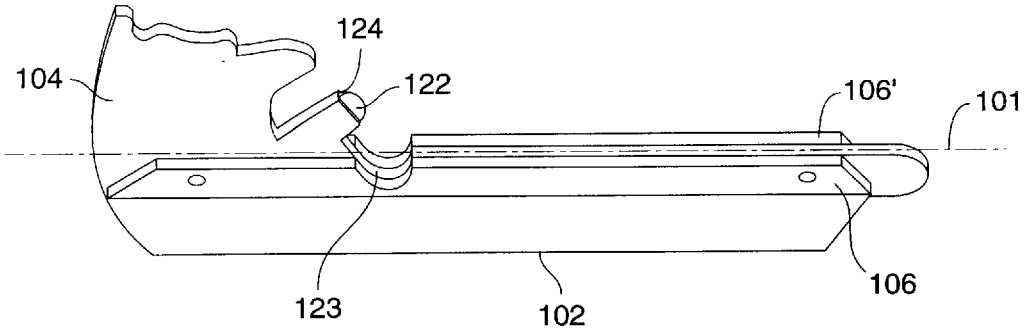
FIG. 6 is a perspective top view of the base plate assembly of FIG. 3.

As shown in more detail in FIGS. 3 and 4, mounting bracket 104 of the present invention includes a back stop 120 for each of the two blades carried by the blade support assembly 300. Back stop 120 preferably includes two substantially flat, coacting bearing surfaces which prevent deflection of the lowermost portion of the blade to the inside (towards a longitudinal central axis 101 of base 102). The first substantially flat bearing surface is provided by inside walls 122, 122' against which an inside surface at the end of blade 14 bears, and a flat shelf 124, 124', which extends substantially perpendicularly from said inside wall 122, 122', and against which the end of blade 14, 14' abuts. As shown in more detail in FIGS. 3 and 5–6, a close fitting groove 123 is provided to prevent deflection of the lowermost corner of the blade 14 to the outside (away from the longitudinal central axis of the base 102). Groove 123 is formed on the cutout 118, which has a corner 125 which is angled as shown, for easing the lowermost corner of blade 14 into the groove 123 as the blade is lowered for cutting, and for urging the corner towards the outer, substantially flat wall of the groove. Thus, back stop 120 and groove 123 provide for positive capture of the blade to prevent any deflection, and cutout 118 provides an outlet for any debris being moved in the groove back towards the edge of the blade by the subsequent entry of additional debris, thus providing a "self-cleaning" cutter.

Figure 8:
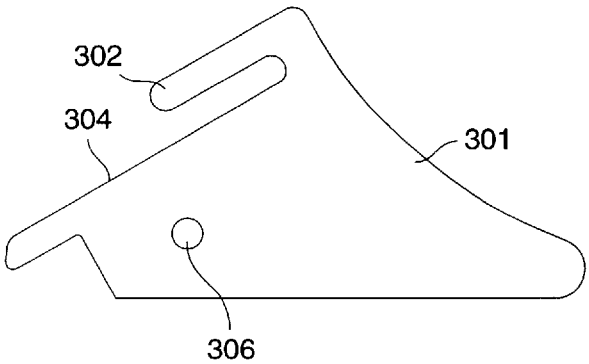
FIG. 8 is a side view of a center plate of a blade support assembly of the present invention.

The preferred blade support assembly 300 includes a center plate 301, shown in FIG. 8. Center plate 301 can be constructed from any substantially rigid, durable material compatible with mounting bracket 104, such as, for example, steel. Center plate 301 includes a tongue 302, shown in FIG. 8, for slidingly engaging the open slot 114 of the mounting bracket 104 as shown in FIG. 2. Center plate 301 also includes a bearing surface 304 for slidingly engaging the bearing surface 116 of mounting bracket 104 in FIG. 2. A hole 306 is preferably also provided in center plate 301 to allow passage of a threaded fastener 10, shown in FIG. 1, which is used to secure a blade 14 in a desired position.

Figure 9:
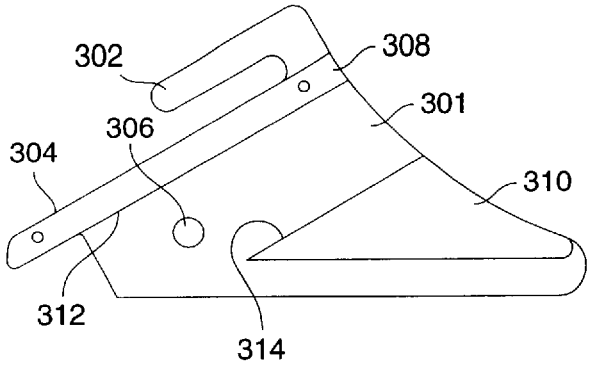
FIG. 9 is a side view of the left side of the center plate shown in FIG. 8, with spacers mounted thereto.
Figure 10:
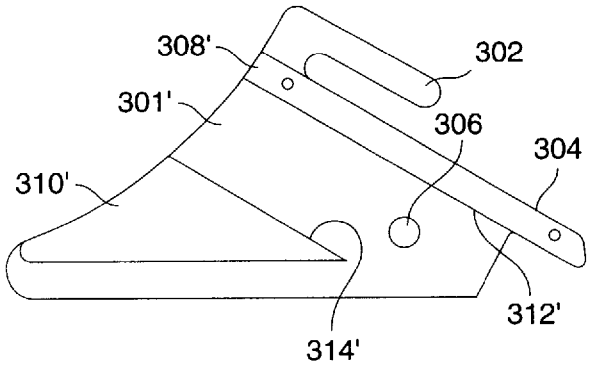
FIG. 10 is a side view of the right side of the center plate shown in FIG. 8, with spacers mounted thereto.
Figure 11:
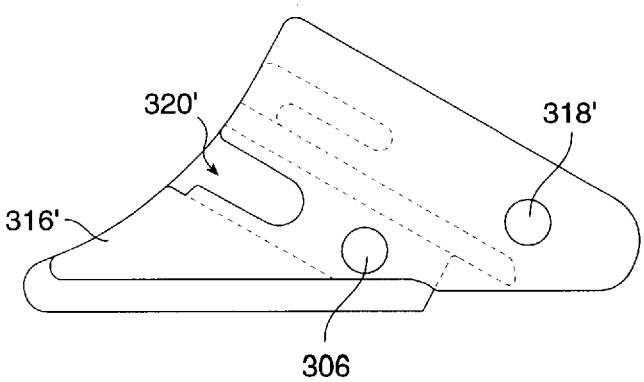
FIG. 11 is a side view of the right side of a blade support assembly of the present invention.
Figure 12:
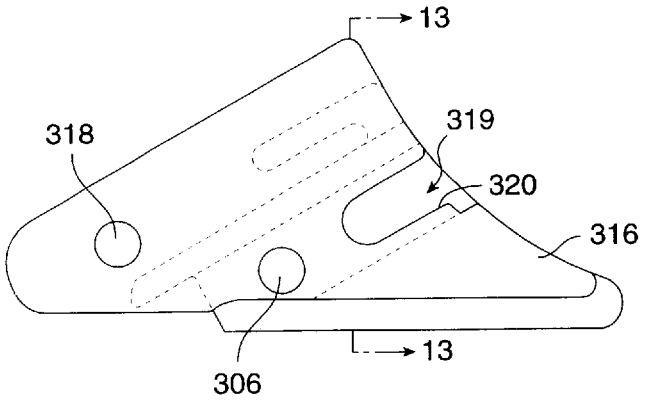
FIG. 12 is a side view of the left side of a blade support assembly of the present invention; and, FIG. 13 is a cross-section of the blade support assembly of FIG. 12, taken through line 13—13.
Figure 13:
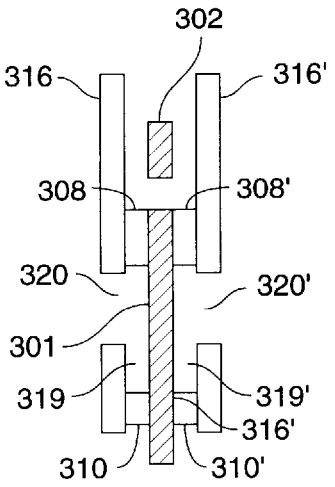

For purposes of reference in explaining the construction of blade support assembly 300, center plate 301 has a left side, depicted in FIG. 9, and a right side, depicted in FIG. 10. A bar spacer 308, 308' and a nose spacer 310, 310' is mounted on each side of center plate 301. Bar spacer 308, 308' is preferably a substantially rigid, durable rectangular bar such as, for example, a flat steel bar, with flat edges, including bearing surface 312, 312'. Likewise, nose spacer 310, 310' is preferably formed from a substantially rigid, durable material like steel, of substantially the same thickness as bar spacer 308, 308', and is provided with substantially flat edges, including bearing surface 314, 314'. Mounted over spacers 308', 310' on the right side of center plate 301 is a right side plate 316' as shown in FIGS. 1 1 and 13. Right side plate 316' is provided with an opening aligned with hole 306, and is provided with a second opening or hole 318' for passage of threaded fastener 12 shown in FIG. 1. The inner surface of right side plate 316', the right side of center plate 301, bearing surface 312' and bearing surface 314' define a right blade compartment 319', with the edges of the blade sliding along and bearing against bearing surfaces 312' and 314'. An open slot 320' allows easy access to the blade compartment 319'. Similarly, as shown in FIGS. 12 and 13, the left side of center plate 301 has a left side plate 316 mounted over spacers 308, 310. An opening aligned with hole 306 is provided, to permit the passage of threaded fastener 10, shown in FIG. 1, and a hole 318 is provided, aligned with hole 318' in the right side plate 316', to permit passage of threaded fastener 12, shown in FIG. 1.

A left blade compartment 319 is defined by the inner surface of left side plate 316, the left surface of center plate 301, bearing surface 312, and bearing surface 314. A slot 320 allows easy access to left blade compartment 319.

To provide the close tolerances needed for accurate cutting, and for producing the substantially flat bearing surfaces which are used in the preferred embodiment of this invention to prevent unnecessary deflection of the blade, the parts for the base plate assembly 100 and the blade support assembly 300 are preferably produced using a computer controlled industrial laser cutter. This is quite different from conventional stamping, which is used to produce the parts used to manufacture devices such as that described in U.S. Pat. No. 3,543,400 to Scott et al., and with which flat surfaces and close tolerances cannot be accurately obtained.

To use a cutter of the present invention, the user can adjust the opening size of the carpet receiving jaw 16 by loosening threaded fastener 12 and sliding the blade support assembly 300 relative to the handle 200 as shown by the arrows in FIG. 1 (e.g., by pulling the front of the blade support assembly 300 away from the rear of the mounting bracket 104) to provide the desired size opening, at which point threaded fastener 12 is tightened to lock blade support assembly 300 in the desired position on mounting bracket 104. Assuming, for the purposes of this example, that the user wishes to make a cut with the left blade 14, the user can place his finger through the open slot 320' to hold the right blade in an "up" position, and loosen threaded fastener 10 to allow the left blade 14 to drop into position. The user can use a finger to make certain the end of the blade engages backstop 120 and to make certain the lowermost corner of the blade has been captured in slot 123, before tightening threaded fastener 10 to secure the two blades in their respective positions. The user then inserts an edge of the carpeting to be cut into the carpet receiving jaw 16 so that the floor engaging base is resting on the floor or other flat surface under the carpet to be cut. The nose 18 is used to guide the cutter between two rows of carpet piles. Blade 14 cuts close to the right hand row of pile as the cutter is pushed along by the user. As bits of carpet backing, and other debris is forced by the movement of the cutter into the slot around the blade, it is forced down and out through cutout 118 by the movement of subsequent debris around the blade, thus no compacting of debris or deflection of the blade is experienced. When the cutting procedure is complete, the user can loosen threaded fastener 10 and invert the cutter to fully retract the blades, and then tighten the threaded fastener 10 to insure the blades remain in the fully retracted position. The carpet receiving jaw 16 can be fully closed for safety in handling by loosening threaded fastener 12 and pushing the front of the blade support assembly 300 towards the rear of the mounting bracket 104. Complete removal of threaded fastener 12 will permit the user to separate the blade support assembly 300 from base plate assembly 100. Likewise, complete removal of threaded fastener 10 will permit the user to remove and replace the blades 14, 14' from the blade compartments 319, 319'.

One skilled in the art will recognize at once that it would be possible to construct the present invention from a variety of materials and in a variety of different ways. While the preferred embodiments have been described in detail, and shown in the accompanying drawings, it will be evident that various further modification are possible without departing from the scope of the invention as set forth in the appended claims.

What is claimed is:

1. A carpet cutter comprising:

a base having a longitudinal central axis;

a blade supporting bracket slidably mounted to said base, said blade supporting bracket having a first and a second blade compartment for securing a leading cutting edge of a blade at an acute angle relative to said base, said blade compartments oriented parallel to and spaced apart from said longitudinal central axis of said base, said first blade compartment positioned to one side of said longitudinal central axis, and said second blade compartment positioned to an opposite side of said longitudinal central axis from said first blade compartment, and said blade supporting bracket being selectively movably towards and away from said base to selectively open and close a carpet receiving slot;

a blade corner engagement means for securing a lowermost corner of said blade against deflection; and, a means for preventing an accumulation of debris around said lowermost corner of said blade.

2. The cutter of claim 1 additionally including an opening at an uppermost end of said blade compartments to provide user access for removing and replacing blades.

3. The cutter of claim 1 wherein said means for preventing accumulation of debris is an opening adjacent to said blade corner engagement means for providing a substantially unobstructed passage to allow debris to move away from said lowermost corner as said blade as said cutter is moved forward during a cutting operation.

4. The cutter of claim 1 additionally including a first substantially flat bearing surface in said blade compartments disposed at the same angle as the blade and positioned so that substantially an entire length of a trailing edge of the blade bears against said flat bearing surface.

5. The cutter of claim 4 additionally including a second substantially flat bearing surface disposed in said blade compartments at the same angle as the blade and positioned to support an uppermost portion of said leading cutting edge of said blade whose lowermost corner is secured by the blade corner engagement means.

6. The cutter of claim 1 wherein said blade corner engagement means includes a first means for preventing deflection of said blade towards said longitudinal central axis and a second means for preventing deflection of said blade away from said longitudinal central axis.

7. The cutter of claim 6 wherein said first means for preventing deflection is a back stop on said base for engaging a bottom end and an inner surface of said blade.

8. The cutter of claim 6 wherein said second means for preventing deflection is a groove in said base having an inside surface angled towards the blade and a substantially flat outside surface for engaging an outer surface of the blade.

9. A carpet face cutter comprising:

a floor engaging base having a bottom surface, a top surface, a bracket, and a longitudinal central axis along said top surface;

a movable plate attached to said bracket forming a forwardly facing carpet receiving slot above and paralleling said top surface of said floor engaging base;

a means for securing said movable plate in a desired position relative to said top surface of said base, at least one downwardly and rearwardly inclined cutting blade spanning a rear end of said carpet receiving slot, said blade disposed in a plane which is substantially perpendicular to said top surface of said floor engaging base and parallel to and spaced apart from said longitudinal central axis, a leading cutting edge of said blade inclined at an acute angle relative to said top surface of said base;

said movable plate being slidably movable along an inclined path paralleling said cutting edge of said blade to selectively open and close the carpet receiving slot;

a means for securing a lowermost portion of the blade against deflection towards the longitudinal central axis;

a means for securing said lowermost portion of the blade against deflection away from the longitudinal central axis; and, a means for preventing an accumulation of debris around a lowermost corner of the blade.

10. The carpet cutter of claim 9 additionally including a blade housing having a means for lowering and raising said cutting blade, and means for securing said cutting blade in a desired position.

11. The carpet cutter of claim 10 wherein said blade housing includes a first substantially flat bearing surface disposed at the same angle as the blade and positioned so that substantially an entire trailing edge of the blade bears against said flat bearing surface.

12. The carpet cutter of claim 11 wherein said blade housing additionally including a second flat bearing surface disposed at the same angle as the blade and positioned to support so much of said leading cutting edge of said blade as remains in said blade housing when the lowermost portion of the blade is secured against deflection.

* * * * *

UNITED STATES PATENT AND TRADEMARK OFFICE

CERTIFICATE OF CORRECTION

PATENT NO. : 5,881,463

DATED : March 16, 1999

INVENTOR(S) : James Vernon Casteel, et. al.

It is certified that error appears in the above-identified patent and that said Letters Patent is hereby corrected as shown below:

Column 6, line 25, change "corner as said blade" to --corner of said blade--

Signed and Sealed this

Eleventh Day of January, 2000

*Attest:*

*Attesting Officer*

Q. TODD DICKINSON

*Acting Commissioner of Patents and Trademarks*